US008687842B2

(12) United States Patent
Yoon et al.

(10) Patent No.: US 8,687,842 B2
(45) Date of Patent: Apr. 1, 2014

(54) COOKER AND CONTROL METHOD THEREOF

(75) Inventors: Yoo-Sool Yoon, Seoul (KR); Jeong-Hyun Lim, Seoul (KR); Koon-Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 13/376,787

(22) PCT Filed: Jun. 15, 2010

(86) PCT No.: PCT/KR2010/003842

§ 371 (c)(1), (2), (4) Date: Dec. 7, 2011

(87) PCT Pub. No.: WO2010/147368

PCT Pub. Date: Dec. 23, 2010

(65) Prior Publication Data

US 2012/0076350 A1 Mar. 29, 2012

(30) Foreign Application Priority Data

Jun. 15, 2009 (KR) ..... 10-2009-0053048

(51) Int. Cl.
*G06K 9/00* (2006.01)

(52) U.S. Cl.
USPC ..... 382/100

(58) Field of Classification Search
None
See application file for complete search history.

(56) References Cited

U.S. PATENT DOCUMENTS

| | | | | |
|---|---|---|---|---|
| 5,747,783 | A | 5/1998 | Myung et al. | |
| 6,008,907 | A * | 12/1999 | Vigneau et al. | 358/1.9 |
| 6,434,267 | B1 * | 8/2002 | Smith | 382/162 |
| 7,253,836 | B1 | 8/2007 | Suzuki et al. | |
| 2002/0012461 | A1 * | 1/2002 | MacKinnon et al. | 382/164 |
| 2006/0081135 | A1 * | 4/2006 | Britton et al. | 99/486 |
| 2008/0137945 | A1 * | 6/2008 | Kang et al. | 382/167 |
| 2008/0250940 | A1 * | 10/2008 | Backus et al. | 99/421 H |
| 2009/0032527 | A1 * | 2/2009 | Lee et al. | 219/679 |

FOREIGN PATENT DOCUMENTS

| | | | |
|---|---|---|---|
| DE | 10 2008 042 804 | A1 | 4/2009 |
| JP | 6-281169 | A | 10/1994 |
| JP | 10-238785 | A | 9/1998 |
| JP | 2001-272045 | A | 10/2001 |
| JP | 2001272045 | A * | 10/2001 |
| JP | 2006-145142 | A | 6/2006 |
| KR | 0182543 | B1 | 3/1999 |
| KR | 10-2005-0115183 | A | 12/2005 |

* cited by examiner

*Primary Examiner* — Stephen R Koziol
*Assistant Examiner* — Raphael Schwartz
(74) *Attorney, Agent, or Firm* — Birch, Stewart, Kolasch & Birch, LLP

(57) ABSTRACT

Provided are a cooker and a method of controlling the cooker. An image of food scanned by an image sensor is corrected, and thus, can be free from distortion due to a lighting device. Accordingly, a user can more accurately recognize a cooking state of the food.

8 Claims, 5 Drawing Sheets

COOKER AND CONTROL METHOD THEREOF

TECHNICAL FIELD

The present disclosure relates to a cooker, and more particularly, to a cooker for scanning food to display a food image, and a method of controlling the cooker.

BACKGROUND ART

Cookers are home appliances for cooking food with electricity or gaseous fuel. Such a cooker includes a heat source for heating food in a cooking chamber. The cooker also includes a temperature sensor or a humidity sensor for sensing temperature or humidity of the cooking chamber. An operation of the heat source is controlled according to temperature or humidity sensed by the temperature sensor or the humidity sensor, thereby facilitating the cooking of the food in the cooking chamber.

DISCLOSURE

Technical Problem

Embodiments provide a cooker that more accurately senses and displays an inner state of a cooking chamber.

Technical Solution

In one embodiment, a cooker includes: a cooking chamber in which food is cooked; a heat source heating the food in the cooking chamber; a lighting source illuminating an inner portion of the cooking chamber; an image sensor scanning the inner portion of the cooking chamber and the food; a display part displaying an image of the food scanned by the image sensor; and a control part correcting a food image distorted by light from the lighting source, to display the corrected food image on the display part.

In another embodiment, a cooker includes: a cooking chamber in which food is cooked; a heat source heating the food in the cooking chamber; a lighting source illuminating an inner portion of the cooking chamber; an image sensor scanning a reference in the cooking chamber and the food; a display part displaying an image of the food scanned by the image sensor; and a control part corrects an image of the food scanned by the image sensor, on the basis of a difference between a preset reference RGB color value of the reference and an RGB color value read from an image of the reference scanned by the image sensor after the lighting source is operated, to display the corrected image on the display part.

In another embodiment, a method of controlling a cooker includes: illuminating, by a lighting source, an inner portion of a cooking chamber; scanning, by an image sensor, the inner portion of the cooking chamber and food; correcting, by a control part, an image of the food distorted by light from the lighting source; and displaying, by a display part, the corrected image of the food.

In another embodiment, a method of controlling a cooker includes: illuminating, by a lighting source, an inner portion of a cooking chamber; scanning, by an image sensor, a reference and food in the cooking chamber; correcting, by a control part, an image of the food scanned by the image sensor, on the basis of a difference between an RGB color value of the reference before the lighting source is operated, and an RGB color value read from an image of the reference scanned by the image sensor after the lighting source is operated; and displaying, by a display part, the corrected image of the food.

The details of one or more embodiments are set forth in the accompanying drawings and the description below. Other features will be apparent from the description and drawings, and from the claims.

Advantageous Effects

According to the embodiments, a user can more accurately recognize a cooking state of food.

MODE FOR INVENTION

A cooker according to a first embodiment will now be described with reference to the accompanying drawings.

Figure 1:
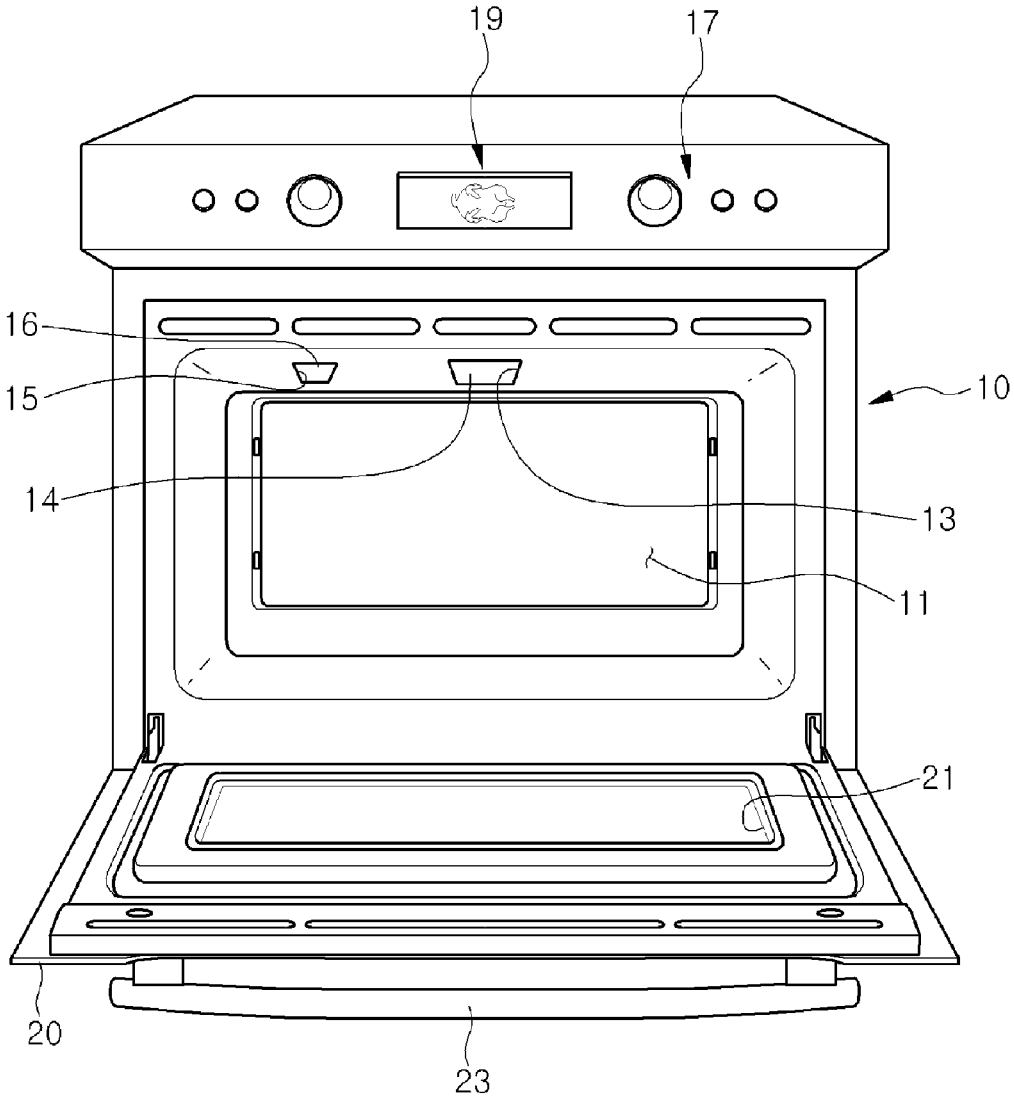
FIG. 1 is a perspective view illustrating a cooker according to a first embodiment.
Figure 2:
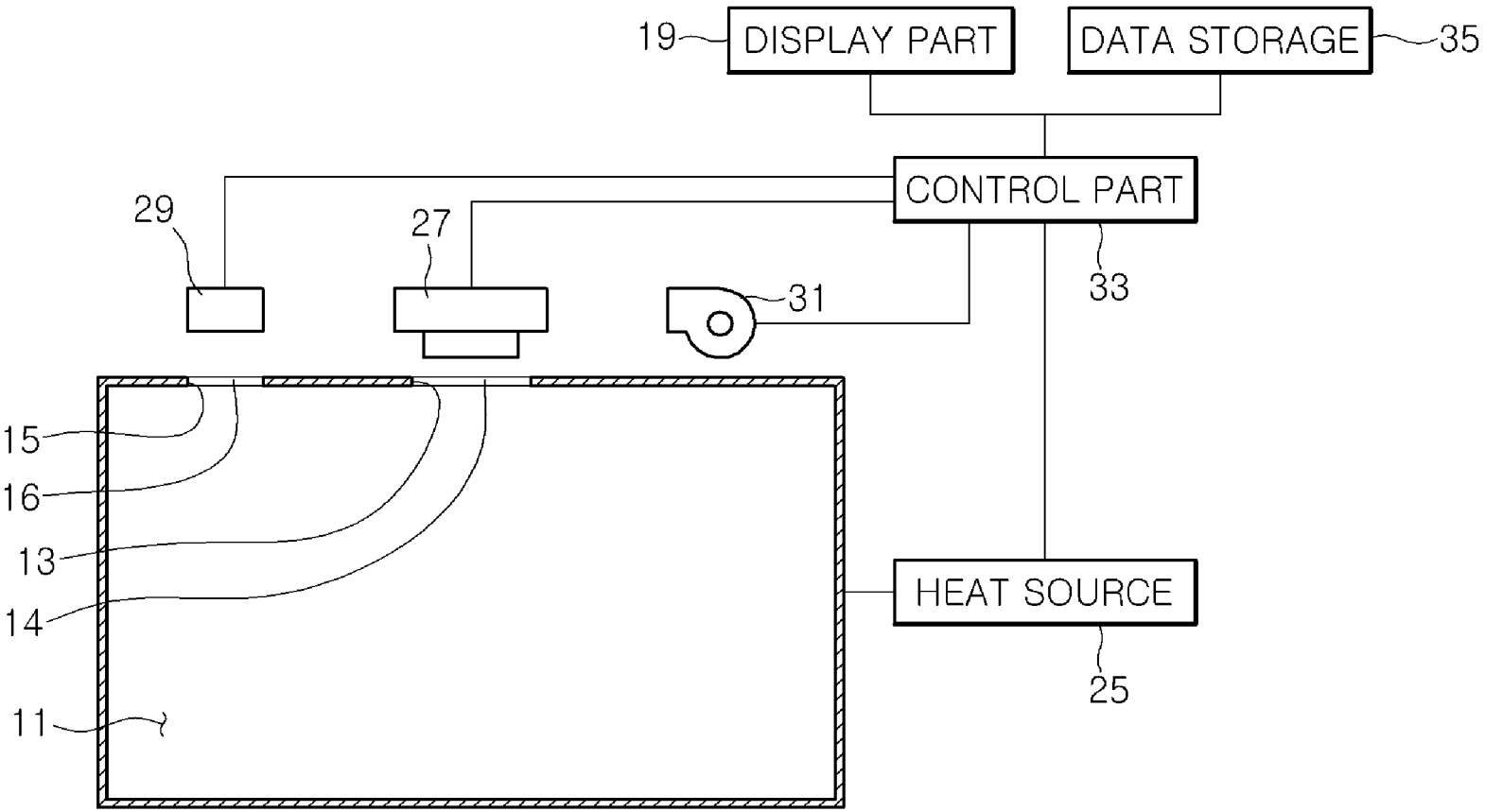
FIG. 2 is a schematic view illustrating the cooker according to the first embodiment.

FIG. 1 is a perspective view illustrating a cooker according to the first embodiment. FIG. 2 is a schematic view illustrating the cooker according to the first embodiment.

Referring to FIGS. 1 and 2, a cooker according to the current embodiment includes a main body 10 that accommodates a cooking chamber 11. Food is cooked in the cooking chamber 11. An inner portion of the cooking chamber 11 is painted flat gray. Accordingly, the image distortion of food due to a lighting device 29 can be minimized.

A sensing opening 13 is disposed at a side of the top surface of the cooking chamber 11. The sensing opening 13 is provided with a shield glass 14. The position of the sensing opening 13 is not limited to the top surface of the cooking chamber 11. For example, the sensing opening 13 may be disposed in one of both side surfaces of the cooking chamber 11, or the rear surface thereof. A lighting opening 15 is disposed at a side of the top surface of the cooking chamber 11.

The lighting opening 15 is provided with a shield glass 16. The lighting opening 15 is disposed in the top surface of the cooking chamber 11 at a side adjacent to the sensing opening 13, but is not limited thereto.

An input part 17 and a display part 19 are disposed on the front upper portion of the main body 10 over the cooking chamber 11. The input part 17 receives an operation signal for operating the cooker. The display part 19 displays an inner state of the cooking chamber 11 sensed by an image sensor 27 to be described later. The input part 17 and the display part 19 are disposed on the front upper portion of the main body 10, but are not limited thereto. For example, the input part 17 and the display part 19 may be disposed on the front left and right portions of the main body 10.

The cooking chamber 11 is selectively opened and closed by a door 20. The front end of the door 20 rotates about a horizontal axis thereof to the front and rear sides of the main body 10. The door 20 is provided with a seeing through window 21. A user can see an inner state of the cooking chamber 11 through the seeing through window 21. For example, the central portion of the door 20 may be formed of a transparent or translucent material to provide the seeing through window 21. The front upper end of the door 20 is provided with a door handle 23 held by a user to open and close the door 20.

A heat source 25 is disposed in the main body 10. The heat source 25 heats food in the cooking chamber 11. For example, the heat source 25 may include at least one of a high frequency heat source emitting microwaves into the cooking chamber 11, and a radiant heat source and a convection heat source supplying radiant heat and convection heat into the cooking chamber 11.

The image sensor 27 is disposed in the main body 10. The image sensor 27 scans the inner part of the cooking chamber 11 and food in the cooking chamber 11. The image sensor 27 is disposed at the upper side of the main body 10 to correspond to the upper side of the cooking chamber 11, particularly, to the upper side of the sensing opening 13 provided with the shield glass 14.

The lighting device 29 is disposed in the main body 10. The lighting device 29 illuminates the inside of the cooking chamber 11. The lighting device 29 is disposed over the lighting opening 15.

A cooling fan 31 disposed in the main body 10 is adjacent to the image sensor 27. The cooling fan 31 generates air flow for cooling the image sensor 27. Although the cooling fan 31 is separately provided to cool the image sensor 27, the image sensor 27 may be cooled by a cooling fan (not shown) for cooling the heat source 25.

The heat source 25, the image sensor 27, and the display part 19 are controlled by a control part 33. In more detail, the control part 33 controls the heat source 25 according to an operation signal input to the input part 17. The control part 33 controls the image sensor 27 to scan food, and controls the display part 19 to display an image of the scanned food. The control part 33 controls the image sensor 27 to scan the food in real time before the heat source 25 is operated, and controls the image sensor 27 to be stopped after the heat source 25 is stopped. The control part 33 also controls the display part 19 to be operated when the image sensor 27 is operated. Thus, the display part 19 and the image sensor 27 simultaneously start to operate, and simultaneously stop.

Light from the lighting device 29 may distort an image of food scanned by the image sensor 27. In this case, the control part 33 compensates for the distortion of the image. For example, the control part 33 reads RGB color values of the cooking chamber 11, from an inner image of the cooking chamber scanned by the image sensor 27 before and after the lighting device 29 operates. The control part 33 corrects an image of food scanned by the image sensor 27 on the basis of a difference between the RGB color values before and after the heat source 25 operates. For another example, an RGB color value read from an inner image of the cooking chamber 11 scanned by the image sensor 27 after the lighting device 29 operates may be compared with a preset reference RGB color value by the control part 33. Then, the inner image scanned by the image sensor 27 can be corrected based on a difference between the reference RGB color value and the RGB color value read from the inner image. The reference RGB color value is read from an inner image of the cooking chamber 11 scanned by the image sensor 27 when the inner portion of the cooking chamber 11 is illuminated with while light.

The control part 33 controls the lighting device 29 and the cooling fan 31. The control part 33 controls the lighting device 29 and the cooling fan 31 to start before or simultaneously with starting of the image sensor 27, and controls the lighting device 29 and the cooling fan 31 to stop after or simultaneously with stopping of the image sensor 27.

Various types of data including the reference RGB color value are stored in a data storage 35.

Hereinafter, the operation of the cooker according to the first embodiment will now be described in more detail.

First, a user rotates the door 20 with food stored in the cooking chamber 11, to close the cooking chamber 11. Then, when the user manipulates the input part 17 to input an operation signal for cooking the food, the control part 33 controls the heat source 25 to operate. Accordingly, the food is cooked in the cooking chamber 11.

The control part 33 starts the image sensor 27 and the lighting device 29 before the heat source 25 starts. Thus, the image sensor 27 scans the inner portion of the cooking chamber 11 in real time, and the display part 19 displays an image of the food scanned by the image sensor 27. The control part 33 controls the cooling fan 31 to start, so that the image sensor 27 is cooled.

The control part 33 may correct an image of the food scanned by the image sensor 27, on the basis of a difference between RGB color values read from inner images of the cooking chamber 11 scanned by the image sensor 27 before and after the lighting device 29 operates. The control part 33 may compare the reference RGB color value with the RGB color value read from the inner image of the cooking chamber 11 scanned by the image sensor 27 after the lighting device 29 operates. A difference between the reference RGB color value and the RGB color value read from the inner image is added to the image of the food scanned by the image sensor 27, or is subtracted therefrom. Thus, image degradation of the food due to light from the lighting device 29 can be prevented.

A cooker according to a second embodiment will now be described with reference to the accompanying drawing.

Figure 3:
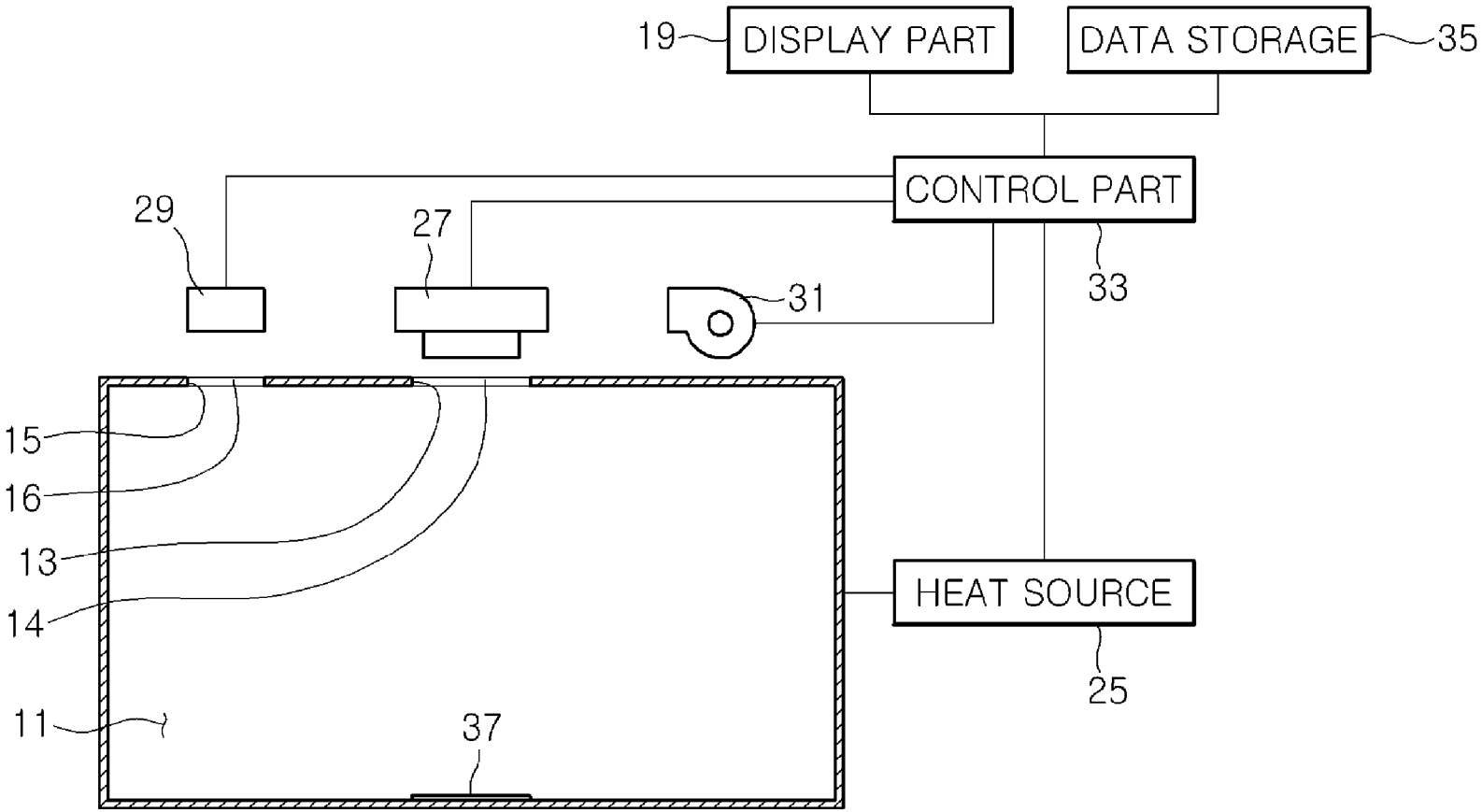
FIG. 3 is a schematic view illustrating a cooker according to a second embodiment.

FIG. 3 is a schematic view illustrating a cooker according to the second embodiment. Like reference numerals denote like elements in the first and second embodiments, and a description of the same components as those of the first embodiment will be omitted in the second embodiment.

Referring to FIG. 3, a reference 37 is disposed in a cooking chamber 11. The reference 37 is used to compensate for the distortion of a food image due to a lighting device 29.

The reference 37 is painted flat gray. An image sensor 27 scans the reference 37 before and after the lighting device 29 operates, so as to from images. Then, a control part 33 corrects a food image on the basis of a difference between RGB color values read from the images. Accordingly, the distortion of the food image due to the lighting device 29 can be compensated for.

A method of controlling a cooker according to the first embodiment will now be described with reference to the accompanying drawing.

Figure 4:
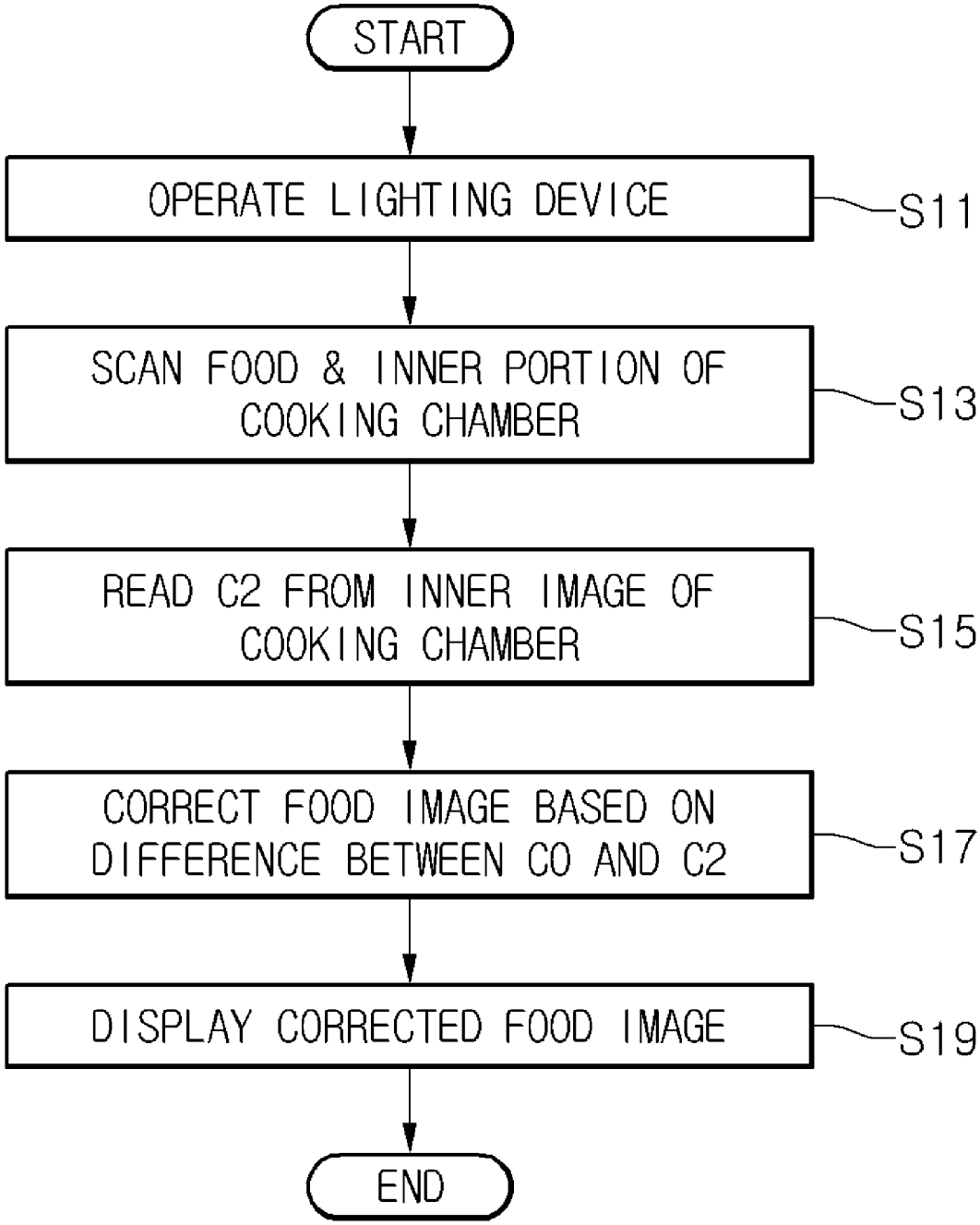
FIG. 4 is a flowchart illustrating a method of controlling a cooker according to the first embodiment.

FIG. 4 is a flowchart illustrating a method of controlling a cooker according to the first embodiment.

Referring to FIG. 4, the lighting device 29 is operated in operation S11. When the lighting device 29 is operated, the image sensor 27 scans the inside of the cooking chamber 11 and food in operation S13.

In operation S15, the control part 33 reads an RGB color value C2 of the cooking chamber 11 from an inner image of the cooking chamber 11 scanned by the image sensor 27. In operation S17, the control part 33 corrects an image of the food scanned by the image sensor 27 on the basis of a difference between a preset reference RGB color value C0 and the RGB color value C2 read in operation S15. Accordingly, image distortion of the scanned food due to light from the lighting device 29 can be compensated for.

In operation S19, the display part 19 displays the food image corrected in operation S17. Accordingly, a user can more accurately recognize a cooking state of the food on the basis of the corrected food image.

A method of controlling a cooker according to the second embodiment will now be described with reference to the accompanying drawing.

Figure 5:
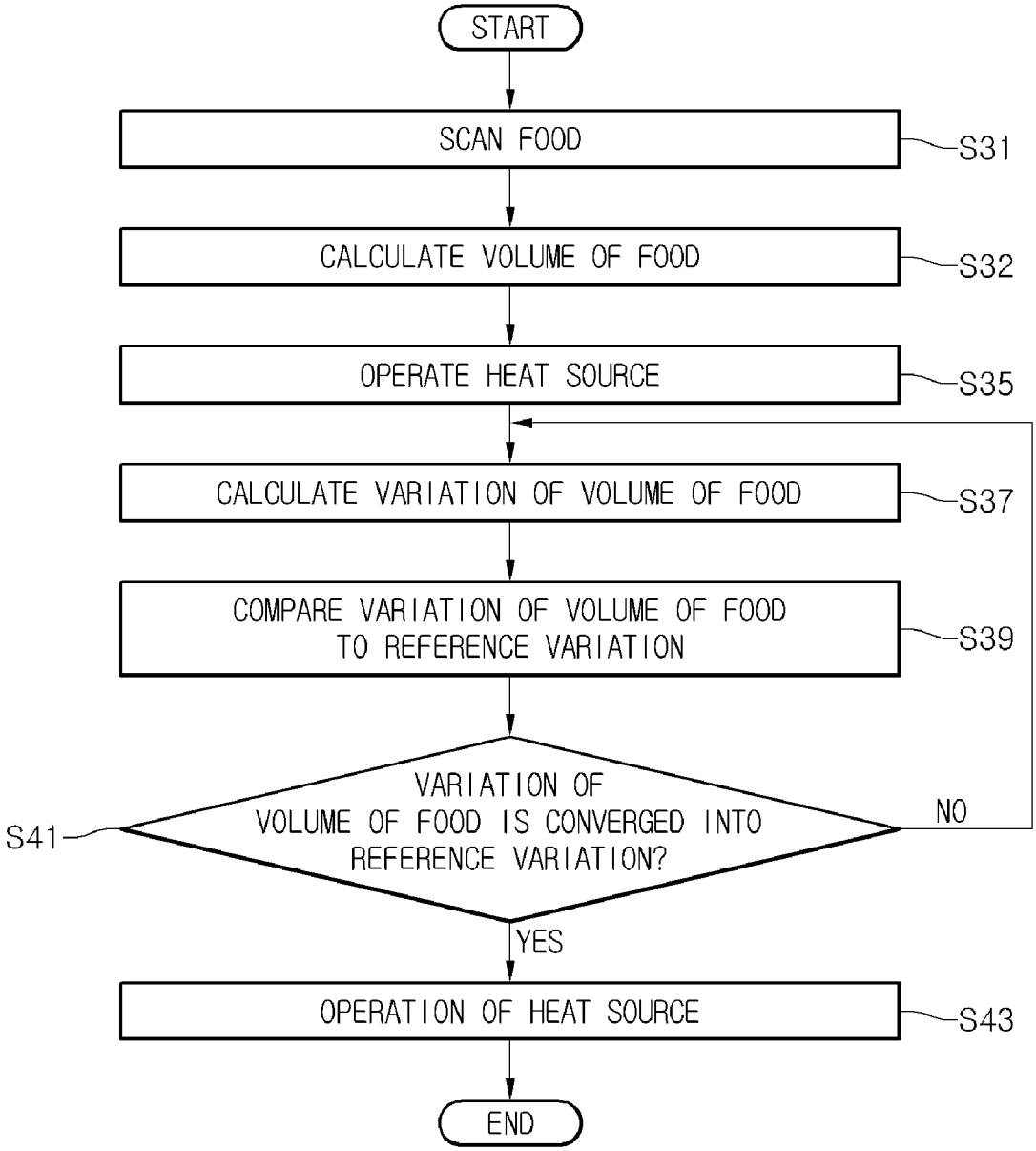
FIG. 5 is a flowchart illustrating a method of controlling a cooker according to the second embodiment.

FIG. 5 is a flowchart illustrating a method of controlling a cooker according to the second embodiment.

Referring to FIG. 5, in operation S31, the image sensor 27 scans the inside of the cooking chamber 11 and food before the lighting device 29 is operated. In operation S33, the control part 33 reads an RGB color value C1 of the cooking chamber 11 from an inner image of the cooking chamber 11 scanned by the image sensor 27 in operation S31.

In operation S35, the lighting device 29 is operated. In operation S39, the control part 33 reads an RGB color value C2 of the cooking chamber 11 from an inner image of the cooking chamber 11 scanned by the image sensor 27 in operation S37, that is, from an inner image of the cooking chamber 11 scanned by the image sensor 27 after the lighting device 29 is operated.

In operation S41, the control part 33 corrects an image of the food on the basis of a difference between the RGB color value C1, read in operation S33, and the RGB color value C2 read in operation S37. In other words, in operation S41, the control part 33 corrects the image of the food on the basis of the difference between the RGB color values C1 and C2 before and after the lighting device 29 operates.

In operation S43, the display part 19 displays the food image corrected in operation S41. Accordingly, a user can see an image of the food, which is not affected by the lighting device 29, that is, an image closer to the real image of the food.

Although the image sensor according to the above embodiment scans the inside of the cooking chamber and food before and after the lighting device operates, the image sensor scans the inside of the cooking chamber and food substantially in real time. In addition, the control part reads and compares RGB color values of the cooking chamber from inner images of the cooking chamber scanned by the image sensor before and after the lighting device operates.

In addition, a food image is corrected based on a difference between RGB color values read from inner images of the cooking chamber scanned by the image sensor before and after the lighting device operates.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

According to the above embodiments, an image of food scanned by an image sensor can be free from distortion due to a lighting device illuminating the inside of a cooking chamber. Accordingly, a user can more accurately recognize a cooking state of the food.

The invention claimed is:

1. A cooker comprising:

a cooking chamber in which food is cooked;

a heat source heating the food in the cooking chamber;

a lighting source configured to illuminate an inner portion of the cooking chamber;

an image sensor configured to scan the inner portion of the cooking chamber and the food; and a control part configured to control the heat source, the lighting source and the image sensor, wherein the control part is configured to operate the image sensor to obtain an inner image of the cooking chamber scanned by the image sensor before the heat source and the lighting source are operated and to determine a first RGB color value based on the scanned inner image of the cooking chamber, wherein the control part is configured to operate the image sensor and the lighting source to obtain an inner image of the cooking chamber scanned by the image sensor before the heat source is operated and after the lighting source is operated and to determine a second RGB color value based on the scanned inner image of the cooking chamber, and wherein the control part is configured to correct an image of the food scanned by the image sensor, on the basis of a difference between the first and second RGB color values.

2. The cooker according to claim 1, wherein at least one inner portion of the cooking chamber has a color or a material not to reflect light from the lighting source.

3. The cooker according claim 1, wherein at least one inner portion of the cooking chamber is painted flat gray.

4. The cooker according to claim 1, further comprising a display part that displays an image of the food scanned by the image sensor.

5. The cooker according to claim 4, wherein the display part displays, in real time, an image of the food corrected by the control part.

6. A cooker comprising:

a cooking chamber in which food is cooked;

a heat source heating the food in the cooking chamber;

a lighting source configured to illuminate an inner portion of the cooking chamber;

a reference disposed in the cooking chamber;

an image sensor configured to scan the reference and the food in the cooking chamber;

a control part configured to control the heat source, the lighting source and the image sensor, the control part being configured to:

operate the image sensor to obtain a first image of the reference scanned by the image sensor before the heat source and the lighting source are operated and to determine a first RGB color value based on the scanned first image of the cooking chamber, operate the image sensor and the lighting source to obtain a second image of the reference scanned by the image sensor before the heat source is operated and after the lighting source is operated and to determine a second RGB color value based on the scanned second image of the reference, and correct an image of the food scanned by the image sensor, on the basis of a difference between the first and second RGB color values; and a display part displaying the image corrected by the control part.

7. The cooker according to claim 6, wherein the reference has a color or a material not to reflect light from the lighting source.

8. The cooker according to claim 6, wherein the reference is painted flat gray, and constitutes the cooking chamber.

* * * * *